US008322106B2

(12) United States Patent
Simmons

(10) Patent No.: US 8,322,106 B2
(45) Date of Patent: Dec. 4, 2012

(54) COLUMN PLUMB STABILIZER

(75) Inventor: Robert J. Simmons, Hayward, CA (US)

(73) Assignee: ConXtech, Inc., Hayward, CA (US)

( * ) Notice: Subject to any disclaimer, the term of this patent is extended or adjusted under 35 U.S.C. 154(b) by 669 days.

(21) Appl. No.: 11/398,366

(22) Filed: Apr. 5, 2006

(65) Prior Publication Data

US 2006/0278800 A1 Dec. 14, 2006

Related U.S. Application Data

(60) Provisional application No. 60/669,423, filed on Apr. 7, 2005.

(51) Int. Cl.
*E04H 12/00* (2006.01)

(52) U.S. Cl. ..... 52/652.1; 52/149; 52/152; 52/170; 52/127.2; 256/19; 256/64; 33/379

(58) Field of Classification Search ..... 52/652.1, 52/651.07, 685, 182, 188, 190, 191, 651.1, 52/146, 149, 152, 170, 127.2, 126.1, 749.1; 248/511, 165, 168, 519, 163.1, 166, 412, 248/188.5, 180.1, 177.1; 256/19, 30, 31, 256/63, 64, 35; 33/379
See application file for complete search history.

(56) References Cited

U.S. PATENT DOCUMENTS 1,568,777 A 1/1926 Smith
1,693,107 A * 11/1928 Campbell ..... 52/638
1,722,352 A * 7/1929 Rawley ..... 52/152
2,031,097 A * 2/1936 Bucky ..... 248/123.2
2,493,978 A * 1/1950 Kromer ..... 248/171
2,646,956 A * 7/1953 Cadwell et al. ..... 248/170
2,826,281 A * 3/1958 Johnson ..... 52/158
2,849,202 A * 8/1958 McCombs ..... 248/515
3,121,556 A * 2/1964 Faulkner ..... 254/2 R
3,225,501 A 12/1965 McCaron
3,312,432 A * 4/1967 Pfeiffer et al. ..... 248/646
4,503,645 A * 3/1985 Nudd et al. ..... 52/40
5,192,055 A * 3/1993 Griggs et al. ..... 256/35
5,271,203 A 12/1993 Nagle
5,697,600 A * 12/1997 Fingerson et al. ..... 256/64
5,704,755 A * 1/1998 Jesperson ..... 414/11
6,684,580 B1 * 2/2004 Hull ..... 52/170
6,725,970 B2 * 4/2004 Garofalo ..... 182/115
6,769,287 B2 * 8/2004 Stewart et al. ..... 73/12.01
7,137,608 B2 * 11/2006 Willey ..... 248/519
7,182,303 B2 * 2/2007 Speggiorin ..... 248/168

* cited by examiner

*Primary Examiner* — William Gilbert
*Assistant Examiner* — Chi Q Nguyen
(74) *Attorney, Agent, or Firm* — Jon M. Dickinson, P.C.; Robert D. Varitz, P.C.

(57) ABSTRACT

A column-base, ground-moveable stand for stabilizing an elongate upright building-frame column, or the like, in a manner which creates and enables adjustable verticality for such a column's long axis. The stand includes (a) spaced, upper and lower, selectively openable/closeable clamping collar structures which are operable to grip the base of such a column at vertically spaced locations along the base of the column, with the collar structures, with respect to a gripped column, defining the disposition in space of the column's long axis, and (b) tilt-adjustable, load-spreading, ground-engaging, outrigger leg structures supportably joined to the collar structures.

3 Claims, 4 Drawing Sheets

COLUMN PLUMB STABILIZER

CROSS-REFERENCE TO RELATED APPLICATION

This application claims priority to prior-filed U.S. Provisional Patent Application Ser. No. 60/669,423, filed Apr. 7, 2005, for "Column Plumb Stabilizer". The entire disclosure content of that prior-filed provisional application is hereby incorporated herein by reference.

BACKGROUND AND SUMMARY OF THE INVENTION

This invention pertains to a stabilizing structure in the form of a ground-engaging stand for stabilizing, into verticality, an elongate upright structural building frame column, or the like, particularly at a point in time during the assembly of a structural building frame when the column is generally positionally in place, but has not yet been anchorably installed or assembled with other components of an emerging building frame structure. In particular, the invention relates to such a stand which can be moved over the ground laterally on a suitable ground-traveling support structure, such as casters, provided adjacent the stand's base, and which can also be lifted upwardly from caster, etc. support to cause it to rest in a stationary position on leveler feet, or the like, which engage the ground—which feet may be adjusted to tilt the stand and any held column appropriately to place the column's long axis into a true plumb and vertical condition.

As the technology of creating components for, and then assembling these components to produce, a structural building frame continues to advance and improve, it has become evident that one area for improvement involves the manner in which a yet unassembled building frame column may be positioned in a proper upright position, well stabilized, in preparation for its becoming anchorably installed with other components in an emerging building frame. Preferably, the supporting of such a column in such a manner is performed through relatively simple and easily maneuvered device which is light in weight, relatively inexpensive, easy to manipulate, and readily linked with, and later unlinked, with a column with respect to which it is employed to provide preassembly column support. Any such device for stabilizing a long, upright column must possess an adequately wide effective footprint relative to the underlying ground in order to avoid any condition where a supported column which is yet unattached to other structure might topple and produce serious damage and injury.

The present invention addresses these concerns and considerations in an innovative and extremely effective manner by providing a plural-leg (outrigger leg structure) stand which includes a pair of vertically spaced, generally central collars, or collar structures, that are openable and closeable to clamp around, and also to release, the base of an upright column of the type generally outlined above. This stand, also referred to herein as a stabilizing structure, with respect to outrigger leg structure, is furnished, in the particular embodiment of the invention illustrated and described herein, with ground-engaging casters (or any other suitable ground-traveling support structure, such as skids) effectively attached near the undersides of the plural legs—which casters may be used to shift the stand along the ground so as to promote easy lateral movement over the ground, and convenient positioning of a held column for proper placement in a building frame.

Additionally, and also located adjacent the undersides of the plural legs in the particular embodiment of the invention now being discussed, are vertically adjustable leveler feet which may be lowered, as by rotational screw action, to lift the stand upwardly so as to take supported weight off the casters, and to transfer such weight directly to the leveler feet which then provide non-ground traveling, and highly stable positional support for the stand and for any held column. These same adjustable leveler feet readily enable appropriate multi-angular tilting of the stand, and therefore of any held and supported column, so as to dispose the long axis of a held column in a true vertical and plumb condition. While screw adjustment is mentioned above, and illustrated herein, as a convenient manner for "leveler-feet" vertical adjustment, other manners of such adjustment, like gear adjustment, hydraulic adjustment, etc., could be used just as well.

Various others features and advantages which are offered by the invention will become more fully apparent as the description which now follows is read in conjunction with the accompanying drawings. In reading about and appreciating these features and advantages, one should be aware that the stabilizer stand of this invention could readily be adapted for use with respect to various column-like, elongate, upright structures which present installation (or other) positioning/handling issues like those described above, and hereinbelow, relating, strictly speaking to structural building-frame columns.

DESCRIPTION OF THE DRAWINGS

In FIG. 3, the stand is illustrated without the presence of the hereinabove, earlier-mentioned casters and leveler feet.

DETAILED DESCRIPTION OF THE INVENTION

Figure 1:
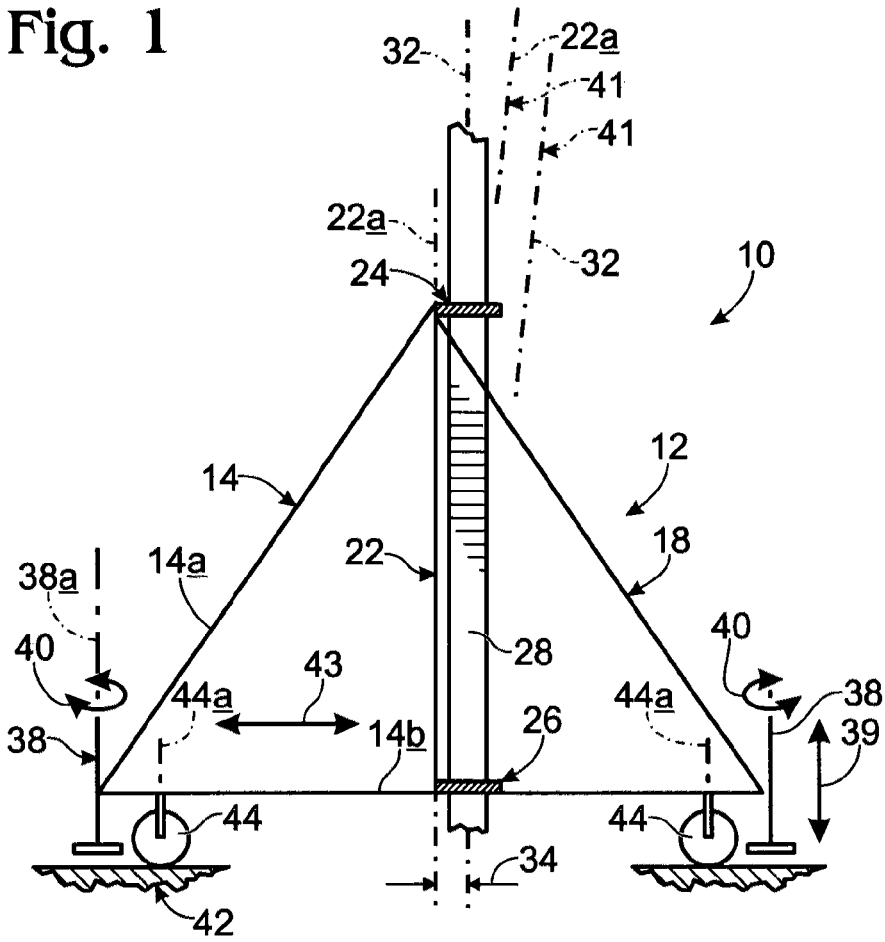
FIG. 1 is a very simplified, schematic side elevation generally illustrating all of the key features of the present invention, with various dash-dot lines being employed to indicate different moved and/or adjusted positions and dispositions for the stand of the invention in accordance with the utility offered by its special features.
Figure 2:
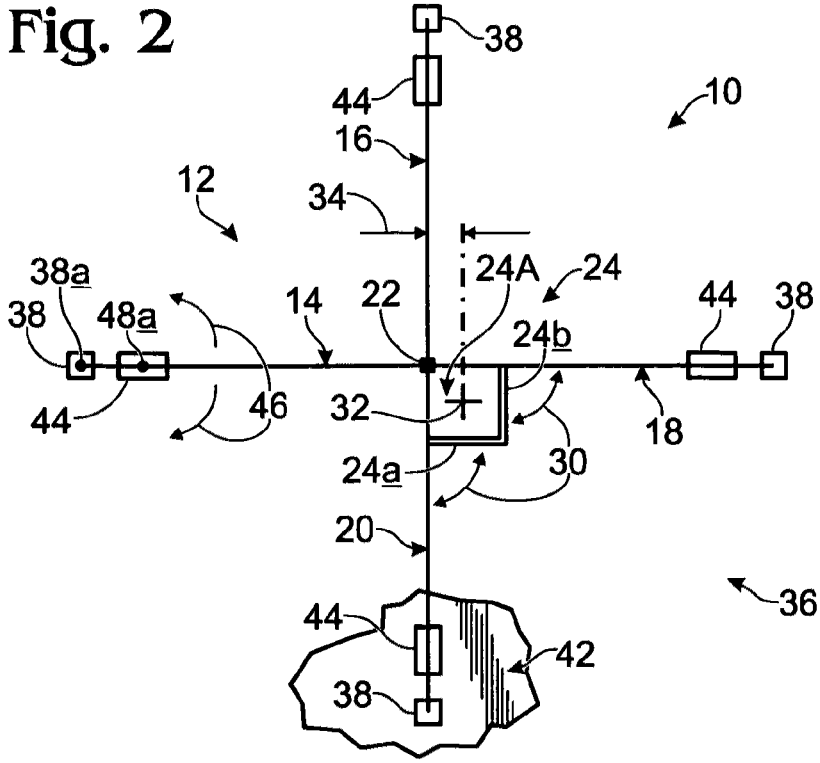
FIG. 2 is also a very simplified schematic view, here showing effectively a plan view of the structure shown in FIG. 1.
Figure 3:
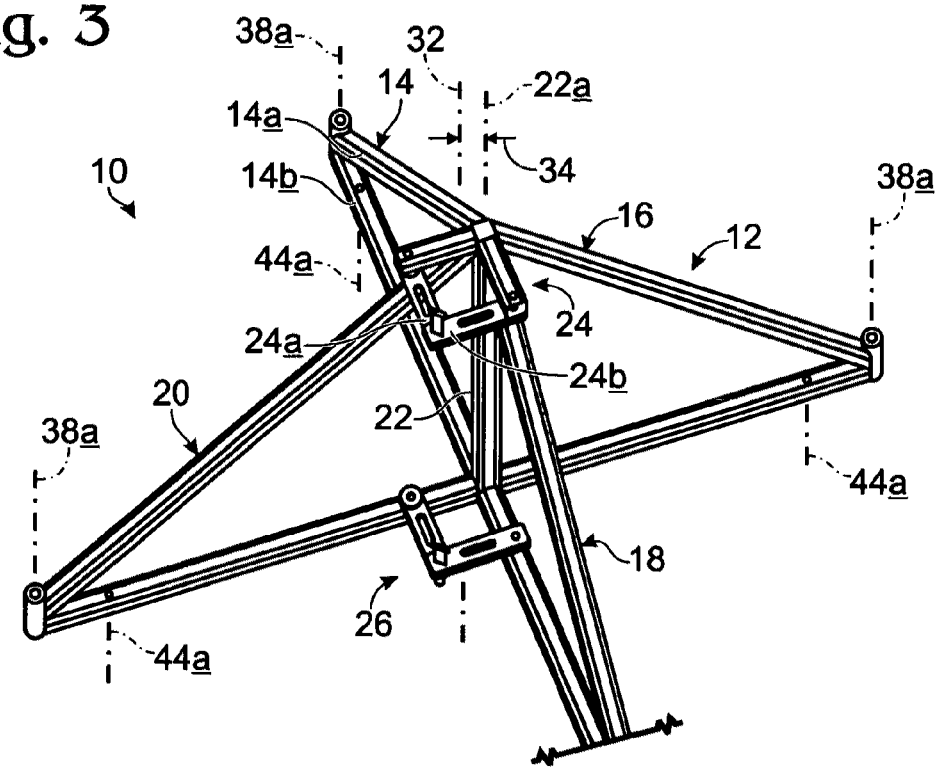
FIG. 3 is a more detailed and larger-scale, downwardly looking, isometric drawing of the stand pictured in FIGS. 1 and 2.
Figure 4:
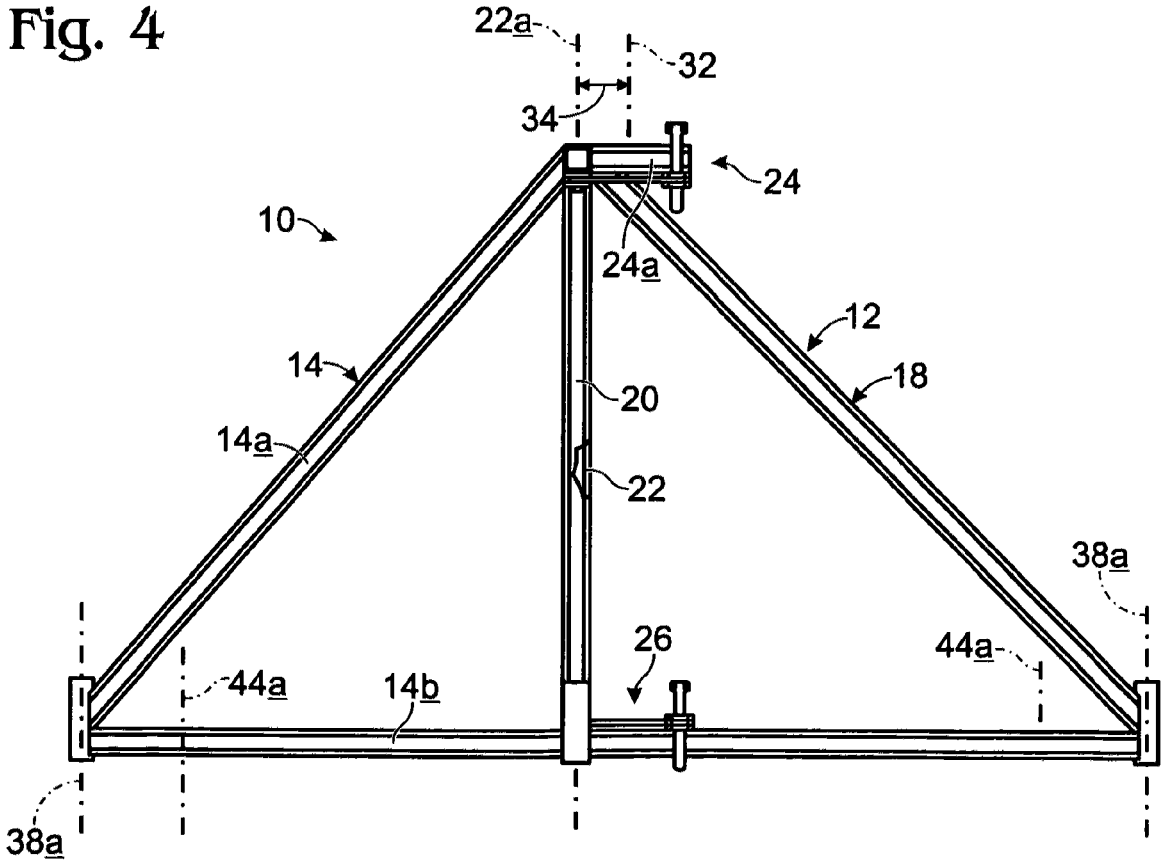
FIG. 4 is a detailed side elevation of the structure shown in FIG. 3.
Figure 5:
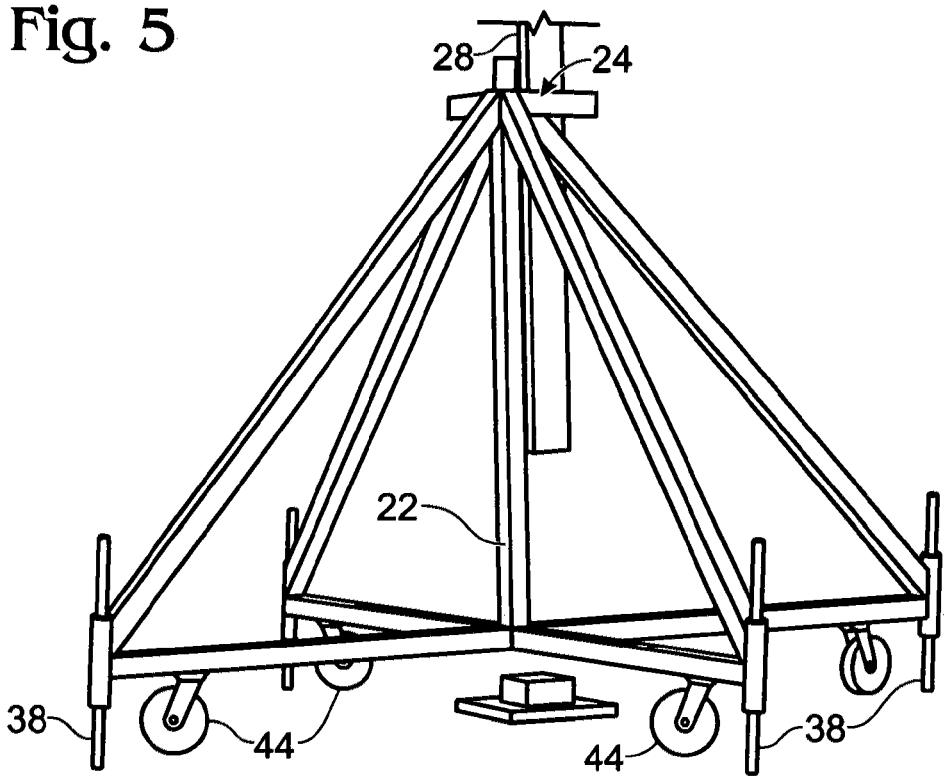
FIG. 5 is a side elevation illustrating a working embodiment of a preferred form of the stand of the present invention, here shown in a condition supported by its leveler feet, with its casters lifted off the ground, and with a column being shown held in place generally centrally in the stand (though slightly laterally offset from the stands' center) by vertically spaced, openable/closeable clamping collar structures.
Figure 6:
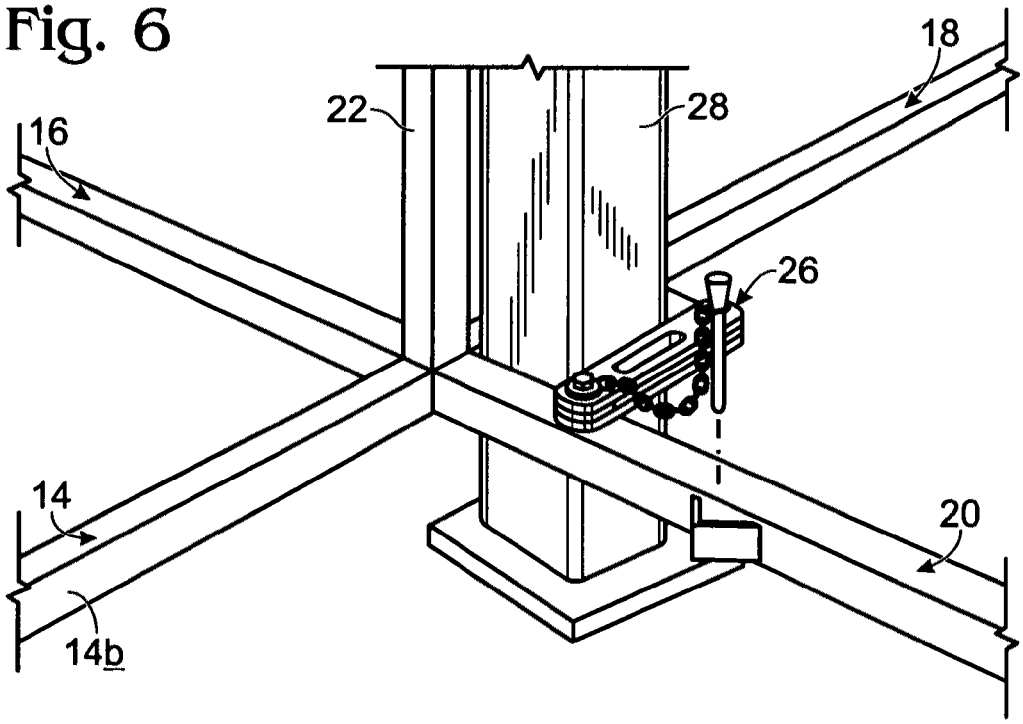
FIG. 6 is a detail presented on a larger scale than that employed in FIG. 5 illustrating features of an upper, column-stabilizing collar.
Figure 7:
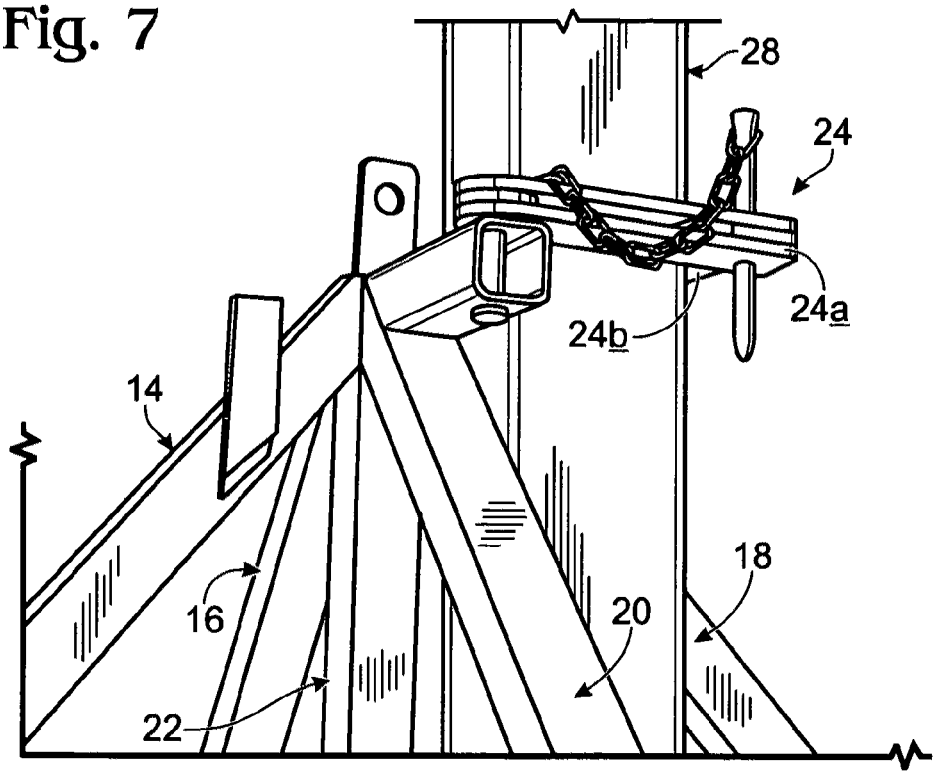
FIG. 7 is like FIG. 6, except that it shows details of one form of a lower collar, or like clamping/holding structure, useable conveniently and successfully in the stand of this invention.

Turning now to the drawings, and referring initially to FIGS. 1-7, inclusive, indicated generally at 10 is a column-stabilizing, or column-base, stand, or structure, which includes load-spreading leg, or outrigger, structure 12 which, in the preferred embodiment of the invention now being described, includes four legs 14, 16, 18, 20, each including upper and lower elongate leg elements, such as upper and lower elongate leg elements 14*a*, 14*b*, respectively, shown particularly in FIGS. 1, 4 and 5 in leg 14. These legs, as viewed from above (see FIG. 2), are disposed in quadrature with respect to one another, and they extend, or radiate, outwardly toward their outer extremities from a central upright spanner element 22 to the upper and lower ends of which they are anchored (i.e., joined in common with). Spanner element 22 defines what is referred to herein as an upright, central stand stabilizing axis shown at 22*a*. Legs 14, 16, 18, 20 are also referred to herein as tilt-adjustable, ground-engaging outrigger structure.

As can be seen, legs 14, 16, 18, 20, as viewed from a side of stand 10 (see especially FIGS. 1 and 4), are generally open, triangular forms, and have their outer extremities substantially residing at the four corners of a generally square footprint (see especially FIG. 2). With respect to stabilizing axis 22*a*, the outer extremities of the two respective pairs of diametrically opposite legs (14, 18 and 16, 20) extend outwardly from this axis each by a distance herein of about 5-feet.

Suitably formed in stand 10, adjacent the upper and lower ends of spanner element 22, are upper and lower collars, or collar structures, 24, 26, respectively. As can be seen, these two collars are aligned generally vertically along spanner element 22. They define a pair aligned and "nearly (but slightly less than) square" spaces, such as space 24A shown in FIG. 2 as defined by closed upper collar 24. These two, aligned spaces and their associated collars are adapted to receive and tightly grip a pair of spaced column base regions in an elongate upright column, such as the column shown generally and fragmentarily at 28 in certain ones of the drawing figures. These collars, which substantially reside in the otherwise vertically open space between legs 18, 20, include hinged, openable and closeable swing arms, such as arms 24*a*, 24*b* in upper collar 24. Opening and closing of these arms is represented schematically by double-headed curved arrows 30 in FIG. 2.

In the particular form of stand 10 now being described, and as generally indicated just above, the arms in the two collars, when closed upon one another to grip an upright column, close in such a fashion that they define, strictly speaking, a not quite (i.e., less than) square space (see especially FIG. 2) which is sized so as to cause the arms, with respect to a collar-received column, to bear tightly against the outer sides of the column so as to restrain the column against vertical relative motion in relation to stand 10. In the particular stand now being described, collars 24, 26 have been sized to receive between their hinged arms, and to grip tightly, a generally square-cross-section, tubular column who sides each have a width of about 8-inches. These collars, with respect to a gripped column, define what is referred to herein as a stabilized axis 32 which becomes essentially coincident with the long axis of every stand-gripped column. As can be seen especially well in FIGS. 1-4, inclusive, stabilized axis 32, which is also referred to herein as a column-stabilizing axis, is offset from, and generally parallel to stabilizing axis 22*a*, which is also referred to herein as a stabilizing-structure stabilizing axis. This offset is indicated generally at 34 in these same four figures, and has special utility in accommodating a central, vertical rigidifying and internal-stabilizing of collars 24, 26 relative to the leg structures in stand 10. Centralized spanner element 22 also plays a useful role in internally stabilizing the four stand outrigger legs, per se.

Looking for a moment, specifically at FIG. 2, indicated generally at 36 is that side of stand 10, referred to herein as a common side, which provides what are referred to herein as aligned, open/openable sides which relate to stand 10 and to collars 24, 26, respectively. When the arms in the clamping collars are open, stand 10 can be moved laterally, and reversibly (as will be discussed more fully later herein) both to receive and to "discharge" a column relative to the collars. Open side 36 corresponds to the above-referred-to open space which resides between legs 18, 20.

Provided adjacent the outer extremities of each of the four legs are vertically adjustable (screw adjustable in the embodiment of the invention now being described) leveler feet, such as those shown at 38 in the drawing figures. These leveler feet are not shown in FIGS. 3 and 4. Selective counter-turning of threaded shafts in leveler feet 38, which shafts extend through threaded receivers joined to the outer extremities of the legs, causes the feet portions of these leveler structures to engage the supporting ground, such as that shown generally at 42 in FIGS. 1 and 2, so as to place the weight of any supported column through the stand and through these feet portions directly to the underlying ground. In FIG. 1, the feet portions of leveler feet 38 are shown out of contact with underlying ground 42. In FIG. 5, these same feet portions are shown contacting the underlying ground. Turning of the mentioned shafts to effect vertical adjustments in the leveler feet is indicated very generally by curved arrows 40 in FIG. 1.

Also provided adjacent the undersides and near the outer extremities of legs 14, 16, 18, 20 are swivel casters 44 which contact the underlying ground to support stand 10 and any gripped column at times when the feet portions in leveler feet 38 are out of contact with the ground. This specifically is the condition which is illustrated in FIG. 1 in the drawings. Casters 44 swivel on vertical axes, as is indicated by arrows 46 located on the left-hand side of FIG. 2 in the drawings. In FIGS. 3 and 4, where the leveler feet and the casters are not illustrated, the respective adjustment axes of the leveler feet are shown by dash-dot lines 38*a*, and the swivel axes of the casters are shown by dash-dot lines 44*a*. See also the left sides of FIGS. 1 and 2 where these two axes are shown.

Vertical adjustment of stand 10, and of any gripped column, through adjustment of the leveler feet is generally indicated by double-headed upright arrow 39 in FIG. 1. It will be apparent that the leveler feet may be operated so as to raise and lower stand 10 in a very uniform (non-tilting) fashion relative to the underlying ground. These very same leveler feet may also be employed with respect to somewhat uneven underlying ground to produce a tilt in stand 10, and in any supported column, as indicated generally by dash-dot lines 41 in FIG. 1, so as effectively to dispose stabilizing axis 22*a* and stabilized axis 32 in true plumb and vertical conditions. In FIG. 1, this tilt is illustrated, just for explanatory purposes, in a somewhat out-of-plumb condition so as to be able to utilize FIG. 1 to explain this tilt-adjustment capability of stand 10. The left and right, slightly right-tilted dashed-dot lines designated 41 represent tilted positions respectively for stabilizing axis 22*a* and for stabilized axis 32. It will be understood from this description that tilt adjustment takes place whenever necessary to support a tilted column in a true upright condition at the location where it is to be installed in a building frame while being supported by stand 10. Double-headed horizontal arrow 43 in FIG. 1 represents lateral movement of stand 10, and of any stand-supported column, over the ground under circumstances where casters 44 furnish load-bearing support for the stand and any such held column.

It will be evident to those skilled in the art that collars 24, 26 may possess different dimensions and different specific constructions in order to accommodate different kinds of columns which are to be supported. Additionally, it will be appreciated that the specific features of these collars, with respect to their exact configurations and articulations for opening and closing, may be changed to suit different applications. FIGS. 3, 4, 6 and 7 illustrate one type of configuration for these collars, with the understanding that the specifics of this configuration are not per se any part the present invention, but are, instead, particularly suitable for handling a column such as above-mentioned column 28.

Explaining now how stand 10 may be employed, and recognizing that this description gives but one illustration of a way for employing the features of stand 10, when a column, such as column 28, is being prepared for assembly into an emerging building frame, it is suitably supported in a dangling and upright condition, preferably with its lower end touching the ground so that it does not swing like a pendulum, with such initial support being provided by any suitable piece of equipment, such as a crane. At this point in time, the column is not necessarily located particularly close to its final location in an emerging building frame, though it may be so located if desired.

With the column so supported, and with the collars' arms swung open, the open sides of the collars and of stand 10 (on stand side 36, between legs 16, 18), and with the stand supported for travel over the ground through casters 44, the stand is shifted laterally toward the subject column until the same becomes received within the now-open collars. The column is now just slightly lifted so that its lower end is raised a suitable clearance distance above the ground, and the collars are then suitably closed by swinging, and clasping (in any suitable manner, as by vertical pinning), of their arms, thus to clamp the column in place relative to the stand, with the column then tightly held against vertical slippage by the collars. At this point in the use of stand 10, the stand is still supported on the ground through casters 44.

In any appropriate manner, the stand with the gripped and supported column is shifted laterally toward the location where the column is to be set in place, typically over an appropriate "weld-to" footing (a mounting site) which has been prepared for column reception at an earlier time. With the column substantially appropriately placed over its mounting site, leveler feet 38 are adjusted to un-weight the casters, and at the same time, through appropriate differential vertical adjustment, if necessary, to orient the long axis of the supported column which is coincident with stabilized axis 32, in a true vertical and plumb condition.

The collars, in any suitable controlled manner, are then relaxed with respect to their grip on the column, and the column is then appropriately "controlled-lowered" by gravity to come to rest on the underlying mounting-site structure to which it will typically be welded ultimately in place. The column may at this point in time be so welded, or it may be retained in a condition gripped by stand 10 until some other stabilizing condition is brought into existence, such as, for example, the coupling of the column to an adjacent column, or columns via an attached beam or beams.

When the column has been successfully placed and independently stabilized, that is, stabilized independently of stand 10, collars 24, 26 are fully opened, and the stand is lowered through adjustment of leveler feet 38 to place weight again upon casters 44. The stand is then shifted laterally away from the now-installed, independently-stabilized column.

Figure 8:
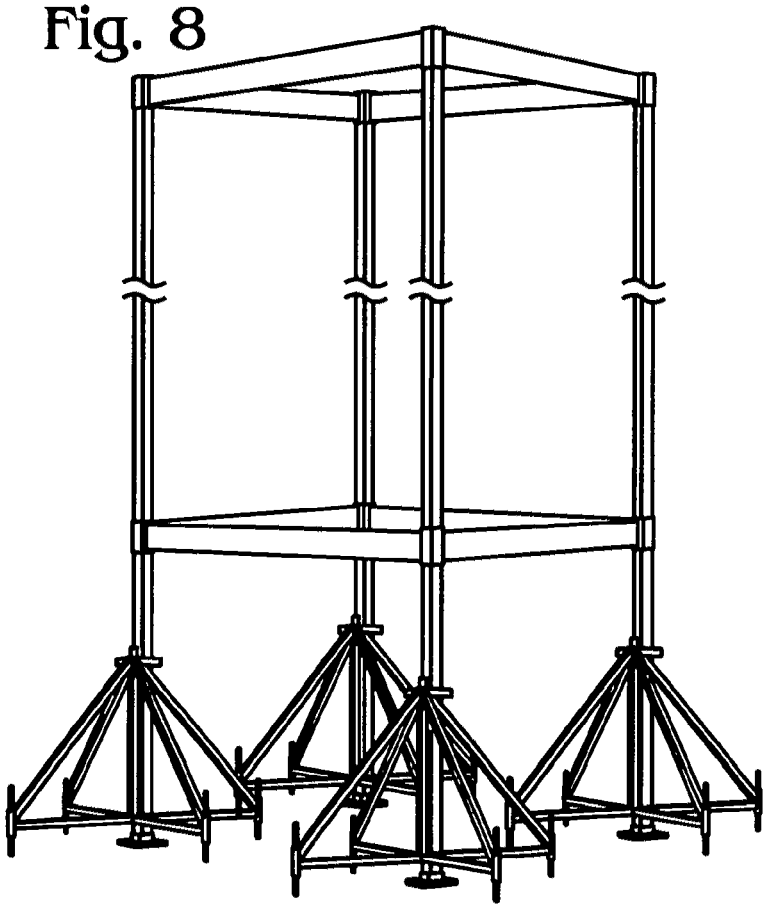
FIG. 8 is an elevation illustrating four upright columns being held in appropriate positions, and being stabilized, by four respective stabilizing stands constructed in accordance with the invention.

A thoughtful look at the various drawings provided herein will fully further inform those skilled in the art about how the just-described procedure is, and may be, implemented. FIG. 8 in the drawings, for example, illustrates a condition (one of many different kinds of conditions involving the assembly a of a structural building frame) wherein four upright columns have been readied for installation in a building frame, with these columns still being fully supported and stabilized by one-each stands made in accordance with the present invention. Other similar conditions are easily visualized by those generally skilled in the art.

Accordingly, a very unique, lightweight, transportable (ground-moveable) stand is provided by this invention for handling the upright stabilizing of a building frame column prior to the time that that column becomes installed and stabilized in components of a building frame per se. The stand of this invention is relatively small and simple in construction, and very clearly is useable in a very intuitive, easy and effective manner. The stand may, of course, be appropriately dimensioned to accommodate different types and sizes of columns, as well as other, like, upright, elongate column-like structures.

The configuration of this stand, which establishes a column-stabilized axis that is offset from a stand-stabilizing axis which is defined by a central, elongate, upright spanner element, such as spanner element 22, results in a stand wherein the two vertically spaced clamping collars designed to hold a column, and the associated outrigger leg structures, are robustly stabilized, per se, within the stand structure as a whole.

From all of the above discussion, read in the context of the accompanying, specific drawings and photo illustrations furnished herein, those skilled in the relevant art will appreciate that many variations and modifications, other than those specifically suggested hereinabove, may be made without departing from the spirit of the invention.

I claim:

1. Structure for vertically stabilizing an elongate column having a long axis which, with the column in a vertically stabilized condition, is upright, such vertical stabilizing occurring during installation of the column in a building frame through the gripping of vertically spaced column regions that are disposed adjacent the base of such a column, said stabilizing structure comprising a central, upright, stabilizing-structure stabilizing axis, spaced, upper and lower, substantially vertically aligned, selectively openable and closeable, releasable clamping collar structures adapted to receive a column for stabilizing, and collectively defining in the structure, for a received column, a laterally offset column-stabilizing axis which is parallel to and spaced from said stabilizing-structure stabilizing axis, said collar structures being operable, when closed, releasably to grip the base of a received column at the mentioned spaced column regions, and in a manner whereby the long axis of a so received and gripped column is upright and coincident with said column-stabilizing axis, and thus laterally offset from said stabilizing-structure stabilizing axis, and ground-engaging, load-spreading, supporting leg structure operatively joined to said collar structures.

2. The stabilizing structure of claim 1 which further includes ground-traveling support structure joined to said leg structure.

3. The stabilizing structure of claim 2 which further comprises screw-adjustable leveler feet operatively joined to said leg structure generally adjacent said ground-traveling support structure.

* * * * *